US009905340B2

(12) United States Patent
Koda et al.

(10) Patent No.: US 9,905,340 B2
(45) Date of Patent: Feb. 27, 2018

(54) RESISTIVE ELEMENT AND METHOD FOR MANUFACTURING THE SAME

(71) Applicant: KOA CORPORATION, Ina-shi, Nagano (JP)

(72) Inventors: Sohei Koda, Nagano (JP); Yuya Takeue, Nagano (JP)

(73) Assignee: KOA CORPORATION, Nagano (JP)

( * ) Notice: Subject to any disclaimer, the term of this patent is extended or adjusted under 35 U.S.C. 154(b) by 0 days.

(21) Appl. No.: 15/102,711

(22) PCT Filed: Nov. 19, 2014

(86) PCT No.: PCT/JP2014/080573

§ 371 (c)(1),
(2) Date: Jun. 8, 2016

(87) PCT Pub. No.: WO2015/087670

PCT Pub. Date: Jun. 18, 2015

(65) Prior Publication Data

US 2016/0358701 A1 Dec. 8, 2016

(30) Foreign Application Priority Data

Dec. 11, 2013 (JP) ..... 2013-256325

(51) Int. Cl.
*H01C 7/00* (2006.01)
*H01C 17/00* (2006.01)
(Continued)

(52) U.S. Cl.
CPC ..... *H01C 7/003* (2013.01); *H01C 1/142* (2013.01); *H01C 7/00* (2013.01); *H01C 17/006* (2013.01);
(Continued)

(58) Field of Classification Search
CPC ..... H01C 7/003; H01C 7/00; H01C 17/006; H01C 1/142; H01C 17/28
(Continued)

(56) References Cited

U.S. PATENT DOCUMENTS 5,966,067 A * 10/1999 Murakami ..... H01C 1/142 338/307
6,150,918 A * 11/2000 Berger ..... H01C 1/014 338/22 R
(Continued)

FOREIGN PATENT DOCUMENTS

JP 63-261701 A 10/1988
JP S63261701 * 10/1988 ..... H01C 7/02
(Continued)

OTHER PUBLICATIONS

International Search Report, and English language translation thereof, in corresponding International Application No. PCT/JP2014/080573, dated Mar. 3, 2015, 5 pages.

*Primary Examiner* — Kyung Lee
*Assistant Examiner* — Iman Malakooti
(74) *Attorney, Agent, or Firm* — Brinks Gilson & Lione

(57) ABSTRACT

A method for manufacturing a chip resistive element including a substrate, a resistor formed on the substrate, and electrodes connected to opposite ends of the resistor, the method including an electrode forming step of forming the electrodes on the substrate. The electrode forming step includes a step of forming a first electrode layer on the substrate using a first electrode material containing silver, and a step of forming a second electrode layer on the first electrode layer using a second electrode material containing silver and palladium. The first electrode material has a higher silver content than the second electrode material.

6 Claims, 10 Drawing Sheets

(51) Int. Cl.
*H01C 17/065* (2006.01)
*H01C 17/28* (2006.01)
*H01C 1/142* (2006.01)

(52) U.S. Cl.
CPC ..... *H01C 17/065* (2013.01); *H01C 17/28* (2013.01); *H01C 17/281* (2013.01)

(58) Field of Classification Search
USPC ..... 338/307, 327
See application file for complete search history.

(56) References Cited

U.S. PATENT DOCUMENTS

| | | | | |
|---|---|---|---|---|
| 7,982,582 | B2 * | 7/2011 | Belman | H01C 1/034 338/307 |
| 2008/0224818 | A1 * | 9/2008 | Tanimura | H01C 1/148 338/309 |
| 2010/0232204 | A1 * | 9/2010 | Muraoka | G11C 13/0007 365/148 |
| 2012/0223807 | A1 * | 9/2012 | Sakai | H01C 1/142 338/327 |

FOREIGN PATENT DOCUMENTS

| | | | | |
|---|---|---|---|---|
| JP | H09-162002 | A | 6/1997 | |
| JP | 11-195505 | A | 7/1999 | |
| JP | 2000-077205 | * | 3/2000 | H01C 17/06 |
| JP | 2000-077205 | A | 3/2000 | |

* cited by examiner

Fig. 7A
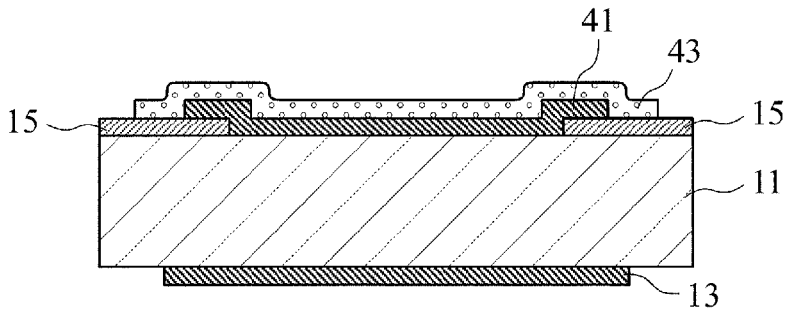
Fig. 7B
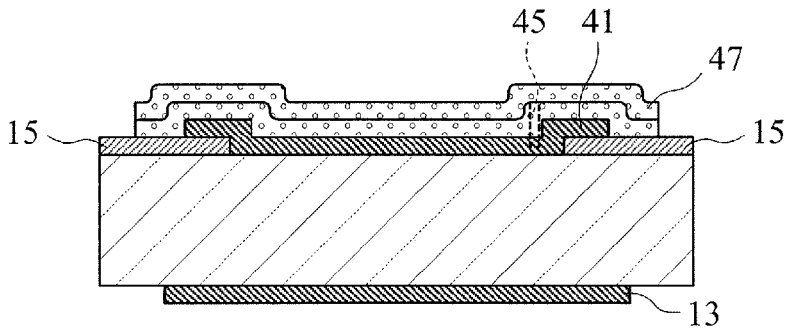
Fig. 8
| | Metal Components | Proportion (wt%) | Layer Thickness (μm) |
|---|---|---|---|
| Second Electrode Material (Upper Layer Electrode) | Ag | 70 - 90 | 5 - 12 |
| | Pd | 10 - 30 | |
| First Electrode Material (Base Electrode) | Ag | 95 - 99.5 | 5 - 12 (Notes: Greater than or Equal to Layer Thickness of Upper Layer) |
| | Pt | 0.5 - 5 | |

RESISTIVE ELEMENT AND METHOD FOR MANUFACTURING THE SAME

RELATED APPLICATIONS

This application is a 371 application of PCT/JP2014/080573 having an international filing date of Nov. 19, 2014, which claims priority to JP 2013-256325 filed Dec. 11, 2013. The contents of these applications are incorporated herein by reference.

TECHNICAL FIELD

The present invention relates to a resistive element and a method for manufacturing the same. More specifically, the present invention relates to a technique of forming electrodes for a resistive element.

BACKGROUND ART

Conventionally, resistive elements connected to wires, which are formed on a printed circuit board and the like, by wire bonding have been used.

For example, Patent Literature 1 discloses a small-size chip resistor that can be bonded by wire bonding and a method for manufacturing the same. In the chip resistor described in Patent Literature 1, a resistor is formed across a first electrode and a second electrode that are formed spaced apart from each other on a chip substrate. Providing a wire on the first electrode can obtain an electrical connection. If a chip resistor is mounted using solder, there will be restrictions such that the chip resistor cannot be used in an environment at a temperature of greater than or equal to the melting point of the solder. However, using wire bonding can avoid such a problem.

In Patent Literature 1, electrodes are formed using metal glaze of silver(Ag)-palladium(Pd)-glass, for example, at opposite ends on an upper surface of a chip substrate made of an alumina sintered body, which is a substrate with an electrical insulating property, in the longitudinal direction thereof, and a resistor is formed using ruthenium oxide ($RuO_2$) between the electrodes. Finally, the electrodes are bonded by wire bonding (see FIG. 10 of Patent Literature 1).

CITATION LIST

Patent Literature

Patent Literature 1: JP H09-162002 A

SUMMARY OF INVENTION

Technical Problem

When electrical connections are obtained by bonding a resistor using wire bonding, how to increase the connection strength between the electrodes of the resistor and bonding wires is an issue. To this end, electrode layers that form each electrode including the surface thereof should be dense. However, the conventional electrodes have problems with the density.

It is an object of the present invention to provide a technique of forming electrodes for a resistor, which are adapted to obtain electrical connections through wire bonding, as dense, thick conductive films.

It is another object of the present invention to provide a resistor having dense electrodes that are suitable for connection of aluminum wires and the like thereto using wedge bonding.

Solution to Problem

According to an aspect of the present invention, there is provided a method for manufacturing a chip resistive element including a substrate, a resistor formed on the substrate, and electrodes connected to opposite ends of the resistor, the method including an electrode forming step of forming each electrode on the substrate. The electrode forming step includes a step of forming a first electrode layer on the substrate using a first electrode material containing silver, and a step of forming a second electrode layer on the first electrode layer using a second electrode material containing silver and palladium. The first electrode material contains a higher silver content than the second electrode material.

As the material of the first electrode layer, which is the lower layer, of the electrode has a higher silver content, diffusion of silver to the second electrode layer, which is the upper layer, becomes dominant when Ag mutually diffuses during heat treatment (baking) and the like. Thus, air bubbles and the like that are generated in the second electrode layer can be filled with the diffused silver, and thus, the electrode becomes dense.

In addition, palladium can prevent migration of silver to the resistor as well as prevent sulfuration of Ag.

The step of forming the first electrode layer includes a step of depositing a paste of a silver-platinum-based metal material and glass as the first electrode material on the substrate. The step of forming the second electrode layer includes a step of depositing a paste of a silver-palladium-based metal material and glass as the second electrode material on the first electrode layer and baking the paste.

The electrode is fused after the second electrode material is baked, and a resistor is formed thereafter. Thus, the electrode becomes dense, and the resistor does not contact the electrode.

The first electrode material contains greater than or equal to 95 wt % silver at a rate of metal components contained in the first electrode material, and the second electrode material contains less than or equal to 90 wt % silver at a rate of metal components contained in the second electrode material.

As the first electrode material contains greater than or equal to 95 wt % (95 to 99.5 wt %) silver at a rate of metal components (excluding glass components) contained in the first electrode material, and the second electrode material contains less than or equal to 90 wt % (70 to 90 wt %) silver at a rate of metal components contained in the second electrode material, mutual diffusion of silver is promoted, and a dense electrode is thus obtained.

The content of palladium is set in the range of 10 to 30 wt % to prevent sulfuration and migration of silver, while the content of platinum is set in the range of 0.5 to 5 wt % to increase the adhesion between the substrate and the electrode.

Herein, the first electrode layer is formed to a thickness of greater than or equal to that of the second electrode layer, whereby diffusion of silver from the first electrode layer with a higher concentration of silver to the second electrode layer is promoted.

According to another aspect of the present invention, there is provided a chip resistive element including a substrate, a resistor formed on the substrate, and electrodes connected to opposite ends of the resistor. Each electrode contains silver, and the electrode includes a silver concentration sloped layer in which a concentration of silver in the electrode is sloped downward in a thickness direction from a substrate side to a side opposite to the substrate.

Further, the electrode includes a palladium-rich layer on the side opposite to the substrate, the palladium-rich layer having a high content of palladium as metal other than silver.

The concentration of silver in the silver concentration sloped layer is sloped in a range of 95 to 90 wt %.

The present specification incorporates the content described in the specification and/or the drawings of JP Patent Application No. 2013-256325 that claims the priority of the present application.

Advantageous Effects of Invention

Forming a dense electrode can reduce damage thereto that may occur during a wire bonding step, an inspection step, and the like, and can increase the contact strength.

BRIEF DESCRIPTION OF DRAWINGS

FIGS. 7A and 7B are cross-sectional views showing the steps of manufacturing the chip resistive element in accordance with this embodiment.

FIG. 8 is a chart showing exemplary metal components, weight rates, and layer thicknesses of a first electrode material and a second electrode material that are the electrode materials of a first electrode layer and a second electrode layer, respectively, forming an electrode.

DESCRIPTION OF EMBODIMENTS

Hereinafter, a resistive element and a method for manufacturing the resistive element in accordance with an embodiment of the present invention will be described in detail with reference to the accompanying drawings.

Figure 1A:
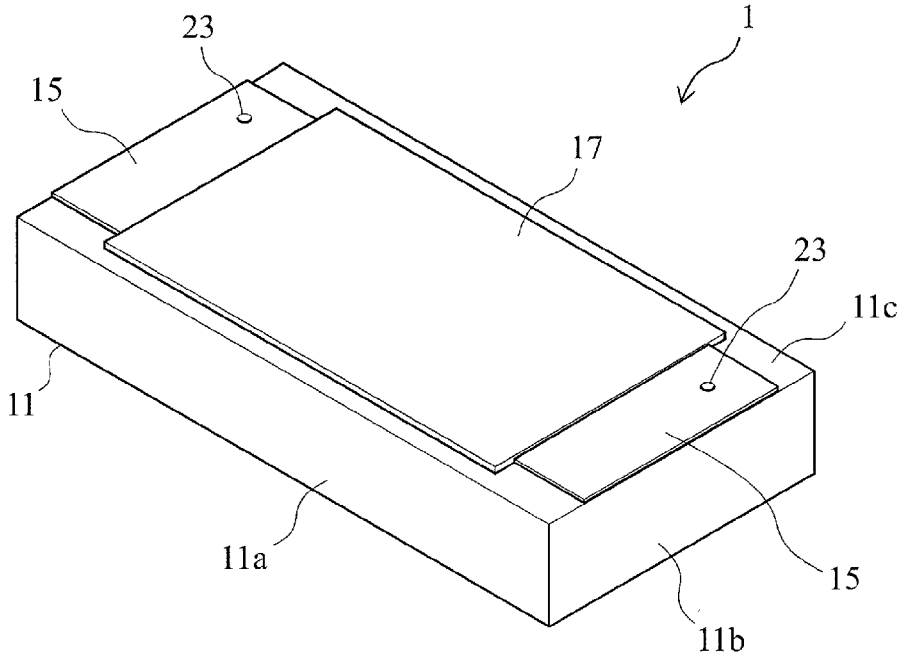
FIGS. 1A and 1B are perspective views each showing an exemplary appearance/configuration of a chip resistive element in accordance with an embodiment of the present invention.
Figure 1B:
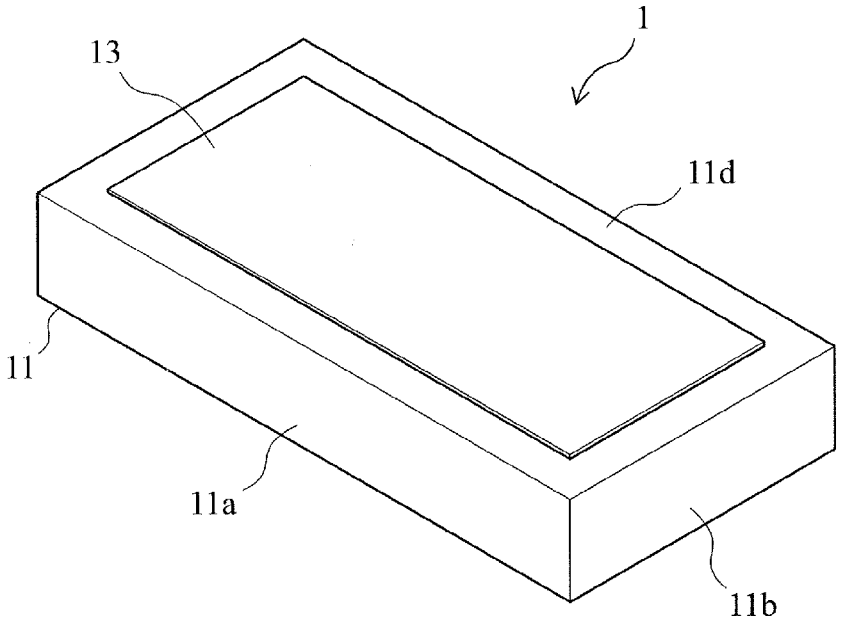

FIGS. 1A and 1B are perspective views each showing an exemplary appearance/configuration of a chip resistive element (hereinafter referred to as a "chip resistor") in accordance with an embodiment of the present invention. As shown in FIGS. 1A and 1B, a chip resistor 1 in accordance with this embodiment is formed using an alumina sintered body, which is a chip substrate 11 with an electrical insulating property, for example, and electrodes 15 are formed at opposite ends of, among side surfaces 11*a*, end surfaces 11*b*, an upper surface 11*c*, and a lower surface 11*d* that are the exposed surfaces of the chip substrate 11, the upper surface 11*c* in the longitudinal direction thereof, for example, and a resistor (not shown) is formed between the electrodes 15, and then, a protective film 17 is formed over the resistor. Each electrode 15 has a probe trace 23 at a position touched with a probe for adjusting the resistance value during the step, for example. An end surface of the electrode 15 is flush with the end surface 11*b* of the chip substrate 11.

As shown in FIG. 1B, the lower surface 11*d* of the chip substrate 11 has a lower surface electrode (i.e., lower surface terminal) 13 formed thereon. The lower surface electrode 13 is provided so as to be connected via solder to a substrate or a lead frame.

Hereinafter, a method for manufacturing the chip resistor in accordance with this embodiment will be described in detail with reference to the drawings. FIGS. 2A, 2B and 2C to 4A, 4B and 4C are top views showing the manufacturing steps, and FIGS. 5A, 5B and 5C to 7A and 7B are cross-sectional views showing the manufacturing steps.

Figure 2A:
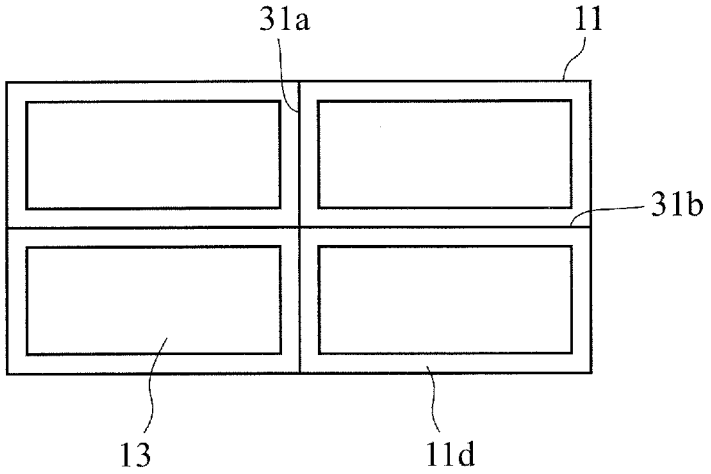
FIGS. 2A, 2B and 2C are top views showing the steps of manufacturing the chip resistive element in accordance with this embodiment.
Figure 5A:
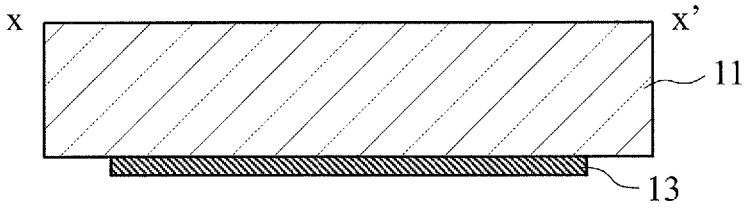
FIGS. 5A, 5B and 5C are cross-sectional views showing the steps of manufacturing the chip resistive element in accordance with this embodiment.

First, as shown in FIGS. 2A and 5A, a large substrate made of alumina or the like is prepared for manufacturing a plurality of chip resistors. Regions of individual chip resistors (hereinafter referred to as "chip regions") are defined on the lower surface side (which corresponds to the lower surface 11*d* side in FIG. 1B), and slits 31*a* and 31*b*, which are arranged in two directions intersecting with each other and adapted to be used for splitting the substrate into individual chip resistors, are formed. The slits 31*a* and 31*b* are formed by performing a pattern pressing step, a laser irradiation step, and the like on a pre-baked substrate. In addition, slits are also formed on the front surface side of the substrate at the same positions.

After that, as also shown in FIG. 5A, the lower surface terminal 13 is formed in each chip region. The lower surface terminal 13 is formed by patterning a paste containing an Ag—Pd-based metal material and glass using screen printing, for example, and baking the paste at 850° C.

Figure 2B:
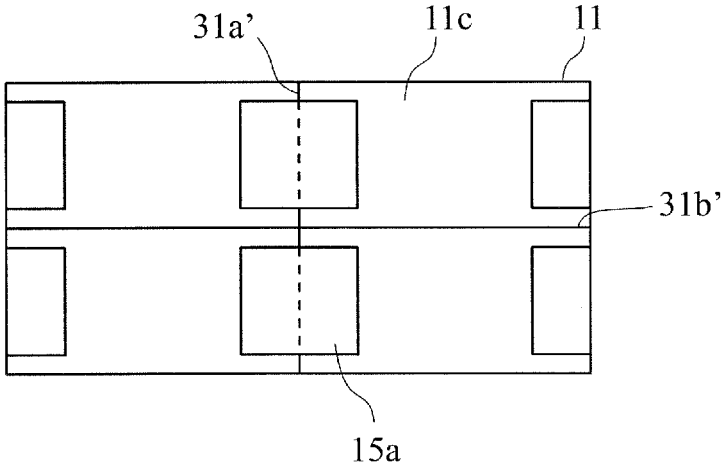
Figure 5B:
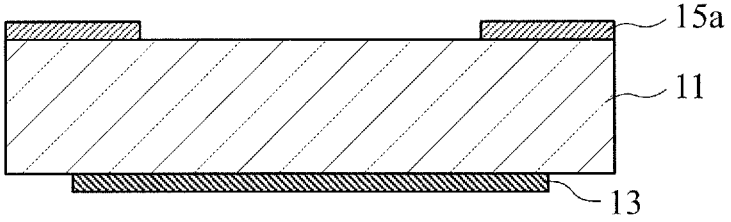

Next, as shown in FIGS. 2B and 5B, a first electrode (i.e., lower layer electrode) 15*a* is formed on the upper surface (i.e., upper surface 11*e* in FIG. 1A) side of the large substrate at a position to stride over the slit 31*a*' on the upper surface side, for example. At this time, a paste containing an Ag—Pt-based metal material and glass is used as the first electrode material, for example, and is patterned using screen patterning, and is then subjected to drying treatment and baking at 850° C. A region where the first electrode 15*a* is formed is a region to be split in two at the slit 31*a*'. Accordingly, when the first electrode 15*a* is split in two along the slit 31*a*', the end surface 11*b* of the chip substrate 11 becomes substantially flush with the end surface of the first electrode 15*a*.

Figure 2C:
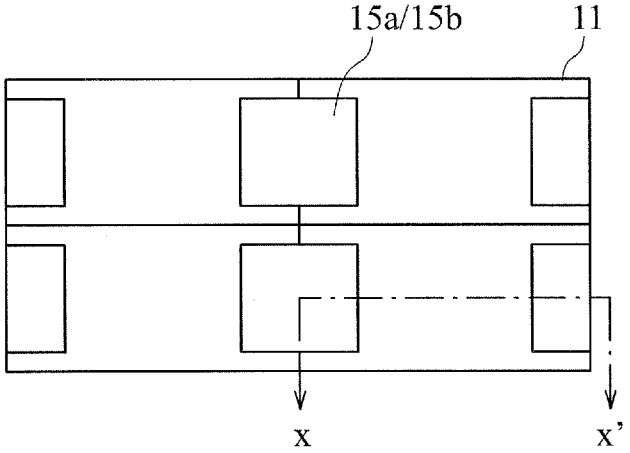
Figure 5C:
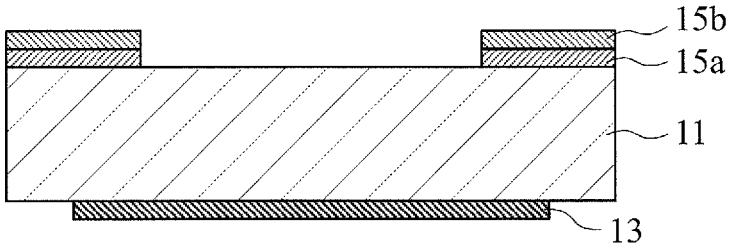

Next, as shown in FIGS. 2C and 5C, a second electrode (i.e., upper layer electrode) 15*b* is formed at a position and a region overlapping the first electrode 15*a*. At this time, a paste containing an Ag—Pd-based metal material and glass is used as the second electrode material, for example, and is patterned using screen printing, and is then subjected to drying treatment and baking at 850° C.

Figure 6A:
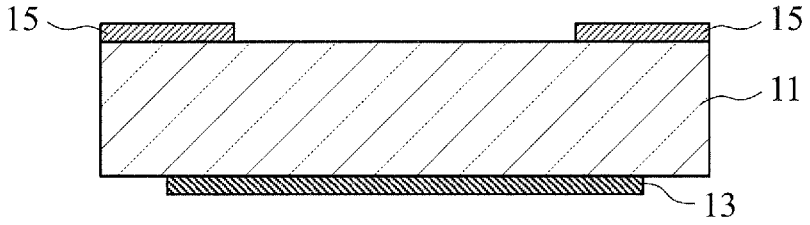
FIGS. 6A and 6B are cross-sectional views showing the steps of manufacturing the chip resistive element in accordance with this embodiment.

Accordingly, as shown in FIG. 6A, the electrode 15, which has been fused based on the first electrode 15*a* and the second electrode 15*b*, is formed on the upper surface side of the chip substrate 11.

The details related to the steps of forming the electrode will be described later.

Figure 3A:
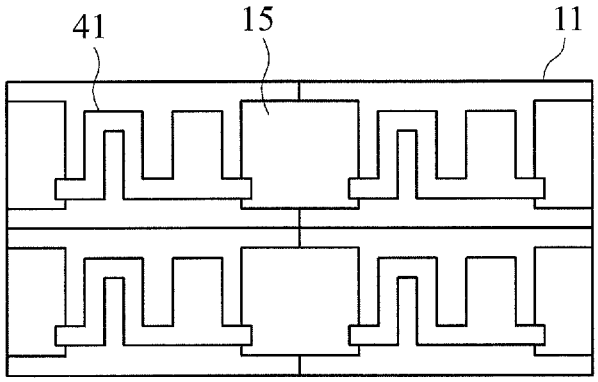
FIGS. 3A, 3B, 3C and 3D are top views showing the steps of manufacturing the chip resistive element in accordance with this embodiment.
Figure 6B:
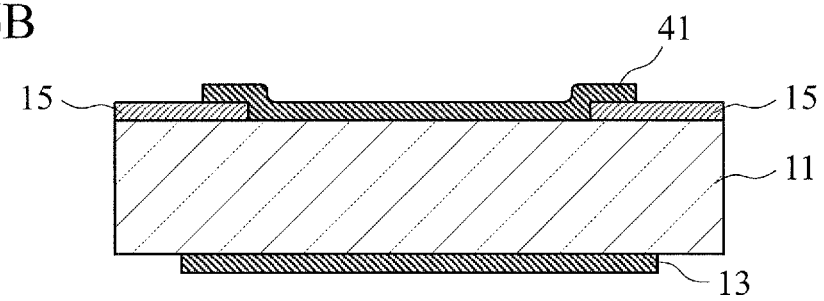

As shown in FIGS. 3A and 6B, a resistor is formed on the upper surface of the substrate having the electrodes 15 formed thereon, using a paste of a resistor material of $RuO_2$ and glass, for example. In order that the opposite ends of the resistor may contact the electrodes 15, screen printing is performed, for example, so as to allow the resistor and the electrodes 15 to be laid one on top of the other and thus obtain an electrical connection therebetween. Next, drying and a baking step at 850° C. are performed to form a resistor 41. Although the resistor 41 is formed by a serpentine pattern in the drawing to increase the withstand voltage, the resistor 41 may be of any shape.

Figure 3B:
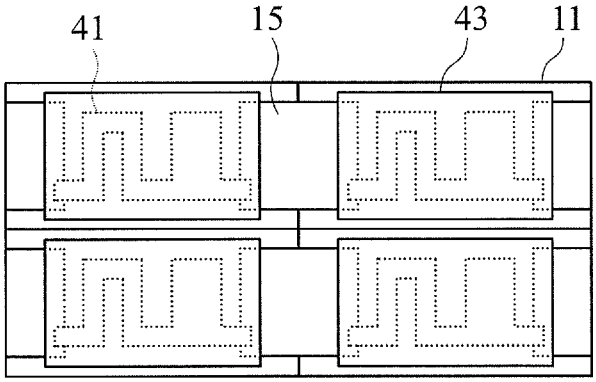

As shown in FIGS. 3B and 7A, a borosilicate glass paste is applied to the upper surface of the chip substrate 11 that has the electrodes 15 and the resistor 41 formed thereon, and screen printing is performed so as to cover the resistor 41. Then, drying treatment and baking treatment at 600° C. are performed to form a primary protective film 43. The primary protective film 43 also has a function of mitigating shocks to the resistor 41 that may occur due to laser trimming described below.

Figure 3C:
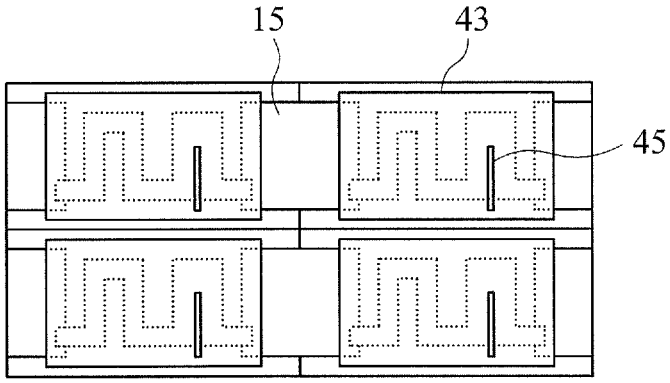

As shown in FIGS. 3C and 7B, a slit 45 is formed in a part of the resistor 41 using a laser processing technique so as to adjust the resistance value of the resistor 41. At this time, the resistance value of the resistor 41 can be adjusted by measuring the resistance between the electrodes 15 while touching the electrodes 15 with probes.

Figure 3D:
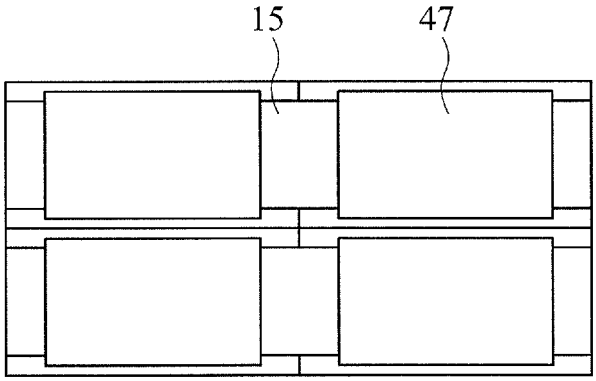

Next, as shown in FIGS. 3D and 7B, a borosilicate glass paste is applied to the upper surface of the chip substrate 11 that has the electrodes 15 and the resistor 41 formed thereon and has an adjusted resistance value, and screen printing is performed so as to cover the slit 45, which has been formed in the resistor 41 using laser, and then, drying treatment and baking treatment at 600° C. are performed to form a secondary protective film 47. The secondary protective film 47 may also be formed using a resin-based material. However, using borosilicate glass can suppress adverse effects on bonding that may result from, if a resin-based protective agent is used, a spread of the resin components on the electrode surface during heat curing treatment.

Figure 4A:
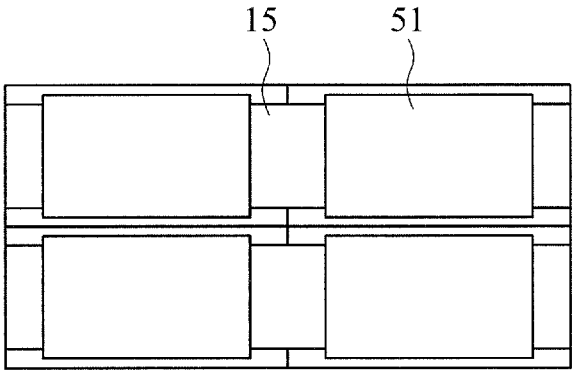
FIGS. 4A, 4B and 4C are top views showing the steps of manufacturing the chip resistive element in accordance with this embodiment.

Next, as shown in FIG. 4A, a tertiary protective film 51 is formed over the secondary protective film 47 using a borosilicate glass paste, from the state shown in FIG. 3D. Accordingly, a number of resistive elements can be formed on the large substrate. It is also possible to use the chip substrate 11 without the slits 31*a* and 31*b* formed thereon up to the step of FIG. 4A, and thereafter form the slits 31*a* and 31*b* while cutting the electrode 15 using laser scribing and splitting the substrate into individual resistive elements through dicing.

Figure 4B:
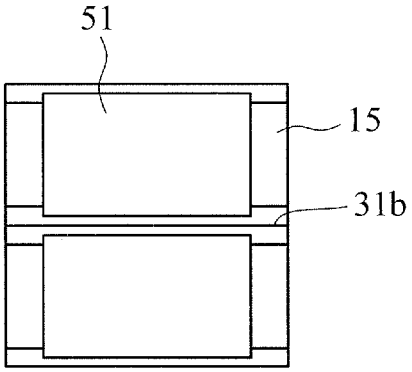

Next, as shown in FIG. 4B, the large substrate is split along the slit 31*a* (FIG. 2A). As the electrode 15 has a relatively high Pd content, there is an advantage in that the electrode 15 can be easily split along the slit 31*a*. If the Pd content in the electrode 15 is low, cracks will be easily generated in the electrode, and thus, the shapes of the split planes may easily vary, while if the Pd content in the electrode 15 is relatively high, cracks will be hardly generated in the electrode, and thus, the shapes of the split planes will hardly vary.

Figure 4C:
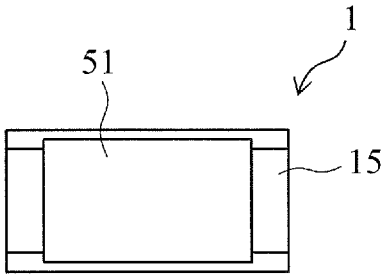

Next, as shown in FIG. 4C, secondary splitting is performed along the slit 31*b* (FIG. 2A), whereby the chip resistor 1 can be created.

Hereinafter, the details of the steps of forming the electrode will be described. The electrode 15 is formed by stacking the second electrode layer (i.e., upper layer electrode) 15*b* made of the second electrode material over the first electrode layer (i.e., base electrode) 15*a* made of the first electrode material. It should be noted that as the electrode layers are fused in the baking step, the resulting electrode in its completed state is not in two layers.

FIG. 8 is a chart showing exemplary metal components, weight rates, and layer thicknesses of the first electrode material and the second electrode material that are the electrode materials of the first electrode layer (i.e., base electrode) 15*a* and the second electrode layer (i.e., upper layer electrode) 15*b*, respectively, forming the electrode 15. As shown in FIG. 8, the first electrode material contains Ag and Pt, for example, and the composition rates are Ag: 95 to 99.5 wt % (greater than or equal to 95 wt %) and Pt: 0.5 to 5 wt %. The layer thickness is 5 to 12 μm, and is greater than or equal to the layer thickness of the second electrode layer 15*b* that is the upper layer. The second electrode material contains Ag and Pd, for example, and the composition rates are Ag: 70 to 90 wt % (less than or equal to 90 wt %) and Pd: 10 to 30 wt %. The layer thickness is 5 to 12 μm, and is less than or equal to that of the first electrode layer 15*a* that is the lower layer. The above example is a preferred example, but even when the proportion of Pd is less than 10 wt %, for example, a proportion of 2 to 10 wt %, predetermined effects are obtained.

When the electrode paste is baked, the vehicle and the solvent may vaporize and the glass components may move, for example, which can result in a non-dense surface state of the electrode. Then, the fixing strength of bonding may not be obtained.

Thus, in this embodiment, an Ag—Pt paste is first printed and baked to form the first electrode layer 15*a* (i.e., base electrode) and then, an Ag—Pd paste is printed and baked to form the second electrode layer 15*b* (i.e., upper layer electrode). In the step of baking the second electrode layer 15*b* (i.e., upper layer electrode) and the first electrode layer 15*a* (i.e., base electrode), the Ag components contained in the two layers mutually diffuse. As the Ag components diffuse from the first electrode layer 15*a* (i.e., base electrode) to the second electrode layer 15*b* (i.e., upper layer electrode), the dense electrode layer 15 is obtained.

Figure 9:
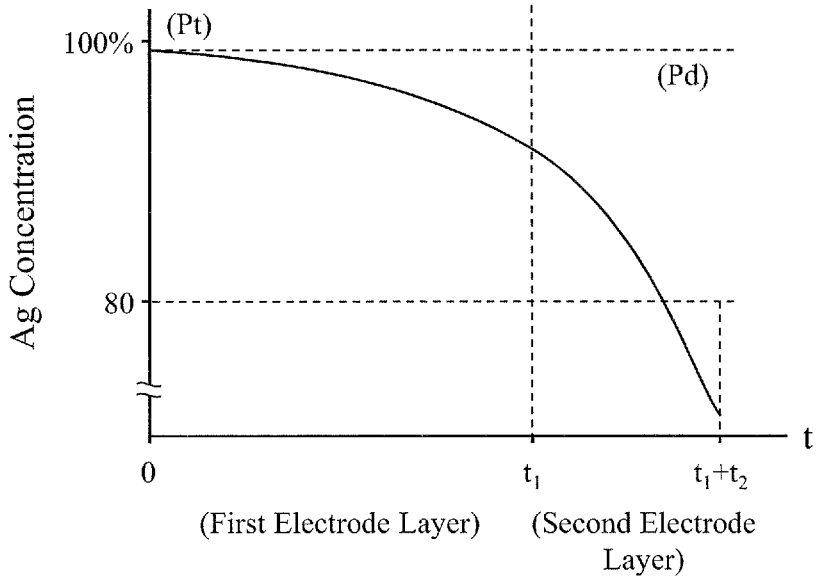
FIG. 9 is a chart showing an exemplary distribution of the Ag concentration after the second electrode layer (i.e., upper layer electrode) and the first electrode layer (i.e., base electrode) are baked.

FIG. 9 is a chart showing an exemplary distribution of the Ag concentration after the second electrode layer 15*b* (i.e., upper layer electrode) and the first electrode layer 15*a* (i.e., base electrode) are baked. As the Ag concentration of the first electrode material is 99% and the Ag concentration of the second electrode material is 80%, a distribution of the Ag concentration is determined based on the concentration gradient of Ag in the mutual diffusion of Ag during baking. For example, as shown in FIG. 9, when the first electrode material with a higher Ag concentration and the second electrode material with a lower Ag concentration than the first electrode material are stacked and baked, Ag moves as a whole from the first electrode material to the second electrode material based on the concentration gradient of Ag in the mutual diffusion step of Ag. Thus, in the electrode 15, the Ag concentration in a region of from the substrate side to the electrode upper surface tends to be sloped downward from the high concentration region toward the low concentration region in the depth direction. This is estimated to be due to the reason that as the first electrode material and the second electrode material containing glass components are deposited and baked at a temperature at which Ag diffuses, voids, such as air bubbles, which are likely to be generated when an electrode paste containing glass components is deposited thick and baked, are filled with the mutually diffused Ag, and thus, a dense Ag-based electrode can be finally formed.

Figure 10:
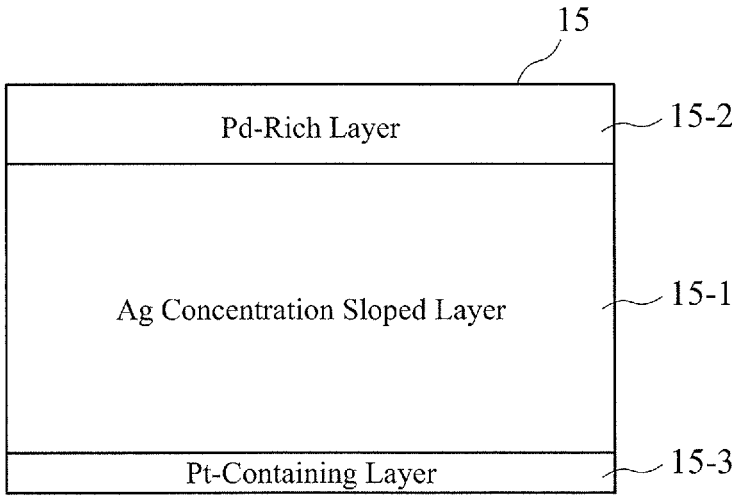
FIG. 10 is a cross-sectional view schematically showing the electrode structure.

FIG. 10 is a cross-sectional view schematically showing the structure of the electrode 15. That is, the electrode 15 is mainly formed of Ag, and has sequentially formed from the substrate side a Pt-containing layer 15-3 containing Pt, an Ag concentration sloped layer 15-1 containing Ag such that the concentration of Ag is sloped downward from the substrate side, and a Pd-rich layer 15-2 having a relatively high Pd content. The Ag concentration in the Ag concentration sloped layer 15-1 is sloped in the range of 95 to 90 wt %.

Herein, as Pd is distributed on the upper side of the electrode, it is possible to suppress migration of Ag to the side of $RuO_2$ that forms a resistor and thus suppress generation of silver sulfide with an insulating property due to sulfuration of Ag. Pt is distributed on the lower side of the electrode 15, that is, on the substrate 11 side. Thus, Pt serves to secure the adhesion strength between the electrode 15 and the substrate. It should be noted that the glass components are distributed on the substrate side, and contribute to increasing the adhesion strength between the electrode 15 and the substrate 11.

Figure 12:
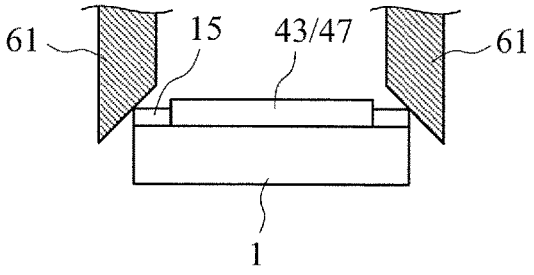
FIG. 12 shows a view in which a secondarily split chip is inspected.

The secondarily split chip is shipped after subjected to inspection and packaging. It should be noted that a Ni film, a Ni—Au film, a Ni—Pd—Au film, or the like may also be formed on the electrode surface using Ni plating (electroplating). Herein, as shown in FIG. 12, if probes 61, which are used for inspection, are allowed to touch the corners of the electrodes 15 of the chip resistor 1 that are formed dense as described above, it is possible to reduce damage and the like to the chip resistor, in particular, to the electrodes 15 while the resistance value of the chip resistor 1 is inspected. (Step after the Chip Resistor is Formed)

Figure 11:
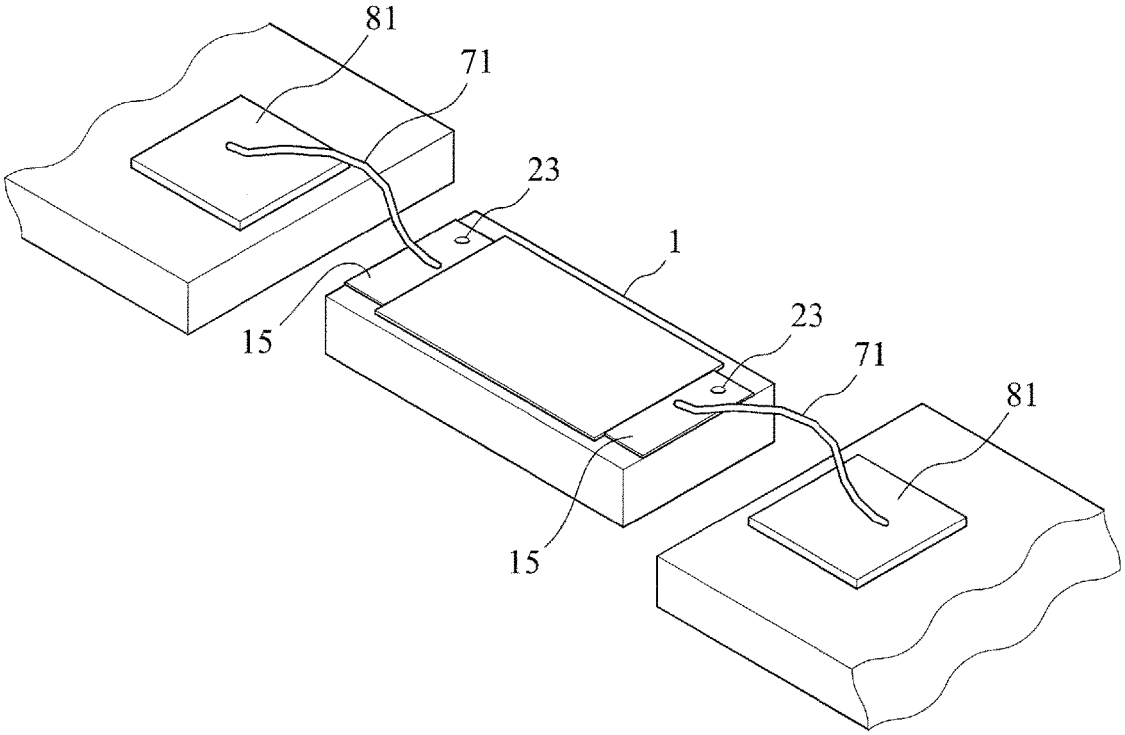
FIG. 11 is a perspective view schematically showing an exemplary mount structure that uses the chip resistor in accordance with this embodiment.

FIG. 11 is a perspective view schematically showing an exemplary mount structure that uses the chip resistor 1 in accordance with this embodiment. As shown in FIG. 11, the chip resistor 1 whose electrodes 15 are exposed at the opposite ends thereof is electrically connected to circuits having bonding pads 81 and the like using bonding wires 71. It should be noted that in the step of adjusting the resistance value in FIG. 3C, the probes are preferably placed at positions off the centers of the electrodes 15 so that the probe traces 23 for measuring the resistance value are not located at the positions where the bonding wires 71 are connected to the electrodes 15 during the step of adjusting the resistance value in FIG. 3C.

Figure 13:
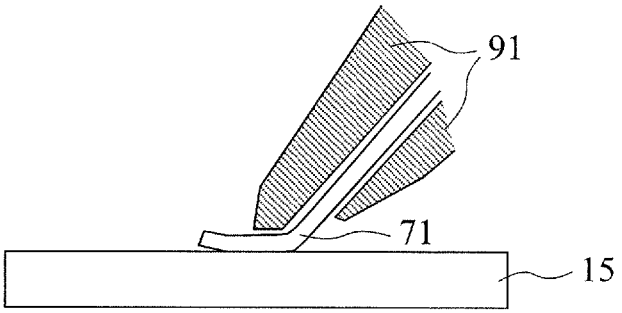
FIG. 13 shows a view in which an electrode is bonded using wire bonding.

FIG. 13 shows a view in which the electrode 15 is bonded using wire bonding. The bonding wire 71 of Al that protrudes from an end of a hole of the probe 91 for wire bonding is pressed against the surface of the electrode 15, and is subjected to ultrasonic bonding, thermocompression bonding, or the like, so that the tip end portion of the bonding wire 71 of Al is bonded to the surface of the electrode 15. In such a case, if the electrode 15 to be bonded is formed dense, the electrode 15 can be suitable as the electrode for connection of the bonding wire of Al to the chip resistor 1 using wedge bonding, in particular. It should be noted that in addition to the bonding wire of Al, a wire of Au and the like may also be used. Further, ball bonding and the like may also be used.

Using the aforementioned electrode forming technique can form a dense electrode, and thus can reduce damage to the electrode in the wire bonding step, the inspection step, and the like as well as increase the contact strength.

In addition, as the electrode is formed in two layers, it is possible to obtain thick electrode layers while preventing cracking and the like, and reduce the resistance values of the electrode layers. Therefore, it is possible to reduce variations of the potential distributions of the electrode layers.

In addition, the electrode surface is formed dense, and the electrode is configured to be connected at the electrode surface to a resistor. Therefore, it is possible to reduce the contact resistance between the resistor and the electrode and increase the pulse resistance. Further, as the electrode can be formed thick, the resistor layer can also be formed thick. Therefore, the pulse resistance of the resistor layer can be increased.

In the aforementioned embodiments, configurations and the like shown in the attached drawings are not limited thereto, and can be changed as appropriate within the range that the advantageous effects of the present invention can be exerted. Further, such configurations can be changed as appropriate without departing from the scope of the object of the present invention.

Each feature of the present invention can be freely selected, and an invention that includes the freely selected feature also falls within the scope of the present invention.

INDUSTRIAL APPLICABILITY

The present invention is applicable to resistors.

All publications, patents, and patent applications that are cited in this specification are all incorporated by reference into this specification.

What is claimed is:

1. A method for manufacturing a chip resistive element including a substrate, a resistor formed on the substrate, and electrodes connected to opposite ends of the resistor, the method comprising:

an electrode forming step of forming each electrode on the substrate, wherein the electrode forming step includes a step of forming a first electrode layer on the substrate using a first electrode material containing silver, and a step of forming a second electrode layer on the first electrode layer using a second electrode material containing silver and palladium, and the first electrode material has a higher silver content than the second electrode material, further wherein the step of forming the first electrode layer includes a step of depositing a paste of a silver-platinum-based metal material and glass as the first electrode material on the substrate, and the step of forming the second electrode layer includes a step of depositing a paste of a silver-palladium-based metal material and glass as the second electrode material on the first electrode layer and baking the paste.

2. The method for manufacturing a chip resistive element according to claim 1, wherein the first electrode material contains greater than or equal to 95 wt % silver at a rate of metal components contained in the first electrode material, and the second electrode material contains less than or equal to 90 wt % silver at a rate of metal components contained in the second electrode material.

3. The method for manufacturing a chip resistive element according to claim 1, wherein the first electrode layer is formed to a thickness of greater than or equal to that of the second electrode layer.

4. The method for manufacturing a chip resistive element according to claim 1, wherein the first electrode material contains platinum.

5. A chip resistive element comprising:

a substrate;

a resistor formed on the substrate; and electrodes connected to opposite ends of the resistor, wherein each electrode contains silver, and the electrode includes a silver concentration sloped layer in which a concentration of silver in the electrode is sloped downward in a thickness direction from a substrate side to a side opposite to the substrate, wherein the chip resistive element further comprises:

a palladium rich layer on the upper side of the silver concentration sloped layer, wherein the palladium-rich layer having a high content of palladium as metal other than silver; and a platinum containing layer containing a platinum under the silver concentration sloped layer.

6. The chip resistive element according to claim 5, wherein a concentration of silver in the silver concentration sloped layer is sloped in a range of 95 to 90 wt %.

* * * * *